United States Patent [19]

Yates

[11] Patent Number: 4,593,196

[45] Date of Patent: Jun. 3, 1986

[54] CHARGED PARTICLE ENERGY SPECTROMETER

[75] Inventor: Kenneth Yates, Crawley, United Kingdom

[73] Assignee: Vg Instruments Group Limited, Crawley, United Kingdom

[21] Appl. No.: 641,203

[22] Filed: Aug. 16, 1984

[30] Foreign Application Priority Data

Aug. 16, 1983 [GB] United Kingdom ..... 8322017

[51] Int. Cl.[4] ..... H01J 40/00

[52] U.S. Cl. ..... 250/305

[58] Field of Search ..... 250/281, 282, 283, 284, 250/398, 399, 300, 305

[56] References Cited

U.S. PATENT DOCUMENTS

| | | | |
|---|---|---|---|
| 3,588,495 | 6/1971 | Halliday et al. | 250/283 |
| 3,800,151 | 3/1974 | Hull | 250/283 |
| 4,048,498 | 9/1977 | Gerlach et al. | 250/305 |
| 4,300,045 | 11/1981 | Ibach | 250/305 |

OTHER PUBLICATIONS

*Zeit fur Phys.* 1935, vol. 97, R. Herzog, pp. 956–602.

*J. Electron Spectrosc. and Related Phenomena,* 1974, Fellner-Feldegg et al., vol. 5, pp. 643–689.

*Discussions of Faraday Society,* 1972, D. L. Ames, et al., vol. 54, pp. 277–284.

*Rev. Sci. Instrum.* 1981, G. V. Hansson et al., vol. 52, pp. 517–522.

*J. Phys. E: Sci. Instrum,* 1980, P. J. Hicks et al., vol. 13, pp. 713–715.

*Proc. Int. Confr. on Electron Spectroscopy,* O. Nilsson et al., Sep. 1971, pp. 141–149.

*Surface and Interface Analysis,* 1983, N. Gurker, et al., vol. 5, p. 13.

*J. Electron Spectroscopy and Related Phenomena,* 1975, C. D. Moak et al., vol. 6, pp. 151–156.

*Primary Examiner*—Bruce C. Anderson

*Attorney, Agent, or Firm*—Bacon & Thomas

[57] ABSTRACT

A charged particle energy spectrometer, typically an electron spectrometer, comprising an electrostatic dispersive charged particle analyzer, e.g. a substantially hemispherical sector analyzer (1,6), and a detector means comprising a plurality of charged particle detectors (26–28) is described. Fringing fields at the exit of the analyzer are corrected by a fringing field corrector plate (7) containing a plurality of apertures (20, 22, 23) each aligned with one channel of the detector means. Exit beam defining slits (21, 24, 25) in a plate (12) situated in the exit focal plane of the analyzer may optionally be provided. Each aperture (20, 22, 23) is preferably the same size and shape as the single aperture used to achieve optimum correction of the fringing fields in a conventional spectrometer having a single channel detector. One or more position sensitive detectors may be used in place of some or all of the detectors (26–28).

19 Claims, 4 Drawing Figures

CHARGED PARTICLE ENERGY SPECTROMETER

This invention relates to spectrometers for measuring the energy of charged particles, e.g. of electrons, and particularly to spectrometers for use in connection with Electron Spectrometry for Chemical Analysis (ESCA), Auger electron spectrometry (AES), and ultraviolet photoelectron spectroscopy (UPS). In ESCA, AES and UPS, the sample is bombarded with an incident beam of radiation or electrons, and the energy of the secondary electrons emitted from the sample is measured using an electron energy spectrometer. The energy spectrum of the emitted electrons is dependent on the nature of the sample and the energy of the incident radiation, and gives valuable information about the chemical nature of the sample. The three processes mentioned, ESCA, UPS, and AES, use different types of primary radiation, namely, X rays, ultraviolet light, and electrons respectively. Particularly with Auger spectrometry, where the primary electrons penetrate only a very small distance into the sample, the secondary electrons are usually emitted from atoms close to the surface of the sample, so that all three processes can be used for analysis of the surface of a sample or of layers adsorbed on it.

Electron spectrometers suitable for use with these techniques may be based on the deflection of the electrons in either a magnetic field or an electrostatic field, or on the retardation of the electron as it travels along a potential gradient, but the electrostatic deflection type are usually employed. There are a number of different types of spectrometers based on electrostatic deflection, but the most common ones are the cylindrical mirror analyser and the hemispherical analyser. This invention is applicable mainly to the hemispherical type, which consists of two concentric hemispheres with a gap betwen them through which the electrons travel. A potential difference is maintained between the hemispheres and the electrons from the sample enter the analyser through a system of slits which define the size and angular divergence of the beam. The electrons are focussed on to an exit slit placed diametrically opposite to the entrance slit, and pass through to a detector, usually an electron multiplier, placed on the other side of the exit slit. Energy selection is achieved by variation of the potential difference between the hemispheres. The focussing properties of the hemispherical analyser were first described by E. M. Purcell in Phys. Rev. 1938, 54, p 818, and many subsequent papers have described improvements to the basic analyser. The focussing properties are in fact very similar to those of a magnetic deflection spectrometer, and the electrons are focussed on the detector in two dimensions, assuming an axially symmetrical input beam.

It will be appreciated that although the most common application of a hemispherical energy analyser is electron energy analysis, it is equally possible to use the device for determining the energy of any other charged species, for example, ions. Thus although the invention will for the most part be described in terms of its application in electron spectroscopy, it will be understood that it may also be used in the measurement of the energy of any other species of charged particles.

In electron spectrometry it is very important that the transmission of electrons through the spectrometer is as great as possible, because the yield of secondary electrons by the techniques of ESCA, UPS and AES is low, and the proportion of the emitted electrons that can be accepted into the spectrometer is also relatively low due to the limited angular acceptance of the spectrometers employed. The use of efficient input lens arrangements which have wide angular acceptance is usual, and full advantage of the focussing properties of the spectrometer must be taken to ensure that the maximum possible number of electrons are transmitted to the detector.

For a hemispherical analyser operated with a particular potential difference between the spheres, the following relationship can be shown to apply:

$$K\alpha^2 + \frac{\Delta R}{2R} = \frac{\Delta E}{E} \quad (1)$$

In equation (1), K is a constant, $\alpha$ is the maximum half angular divergence of the input beam in the dispersion plane which is accepted by the analyser, $\Delta R$ is the width of the entrance and exit slits which determine the resolution of the spectrometer, R is the radius of the central trajectory between the hemispheres, $\Delta E$ is the difference between the lowest and highest energy passed by the analyser at a given potential difference between the spheres, and E is the energy at the centre of the passband at the same potential difference (the pass energy). Consequently, in order to obtain the maximum resolution, $\Delta E/E$ it is necessary to restrict the values of $\alpha$ and $\Delta R$, which will clearly seriously reduce the transmission of the analyser.

Equation (1) also shows that for a given transmission, the highest resolution is obtained at the lowest value of E, so that it is conventional to operate the analyser at a low pass energy and to retard the electrons emitted from the sample to the pass energy of the analyser by means of a retarding lens situated at the entrance to the analyser. Usually, the pass energy is held constant, and the energy spectrum is scanned by varying the degree of retardation over the required range of energies.

Clearly, an theoretical performance of the analyser can only be achieved in practice if the behaviour of the real analyser conforms in all respects with the theoretical model. The theoretical treatment of the hemispherical analyser as given by Purcell and subsequent workers assumes that at the entrance and exit of the analyser there exists a step function in the electrostatic field between zero and the value between the hemispheres, but this cannot be achieved in practice. In a real analyser, the effect of the fringing fields at the entrance and exit is to increase the aberrations and reduce the resolution of the spectrometer. It is well known that the effect of these fringing fields can be reduced by the provision of an additional pair of slits, known as Herzog slits, one situated between the entrance slit and the entrance face of the hemispheres and the other situated between the exit slit and the exit face of the hemispheres. These slits, together with the entrance and exit slits themselves, are usually but not essentially maintained at the potential of the central trajectory through the hemispheres. The field between the hemispheres is proportional to $1/r^2$, where r is the radial distance from the centre of the hemispheres, so that the potentials of the hemispheres are not equally balanced about the slit potential, but are selected to generate a field which is proportional to $1/r^2$ with the potential along the central trajectory equal to the slit potential. In the analysis techniques described, it is common practice to maintain the sample at earth potential, and to retard the secondary electrons to the pass energy of the analyser. Therefore, $$KE = V_R + HV_A + W \quad (2)$$

where KE is the kinetic energy of the electrons to be measured, $V_R$ is the retardation potential applied before the electrons enter the analyser, H is a constant characteristic of the analyser, $V_A$ is the potential between the analyser hemispheres, and W is the work function of the spectrometer (included because the measured energies are always referred to the Fermi level). In equation (2), the retardation potential $V_R$ will be the difference between the sample potential (earth) and the analyser entrance slit potential, and clearly, if KE is less than $V_R$, the electrons will be accelerated into the analyser rather than retarded.

The dimensions of the Herzog slits are usually adjusted according to the theory outlined by R. Herzog in Zeit. fur Physik, 1935, 97, p 596, although this theory, which was derived for a different type of analyser, may not be strictly valid. In practice, however, Herzog slits made according to the theory provide adequate correction, and reduce the aberrations of a real spectrometer by compensating for the effects of the fringing fields.

In many practical spectrometers, the Herzog slits are combined with the entrance and exit slits, but this means that a compromise has to be made on either the size of the entrance and exit slits so that optimum fringing field compensation is obtained, or on the quality of the fringing field compensation when other entrance and exit slit sizes are required. With a high performance spectrometer it is better to employ separate Herzog and entrance and exit slits, but because the entrance and exit slits must lie in a plane through the centre of the hemispheres, and the Herzog slits must be positioned between the entrance and exit slits and the appropriate face of the hemispheres, it is necessary to reduce the sector angle of the hemispheres from 180°, typically to about 150°, to allow the Herzog slits to be fitted. This does not significantly change the focussing properties of the spectrometer.

In simple spectrometers, a single detector such as an electron multiplier is placed behind the exit slit so that electrons of a small range of energies, corresponding to the minimum resolution of the spectrometer, are detected at any particular setting of the pass energy of the spectrometer. However, the hemispherical analyser exit slit is situated in a focal plane of the hemispherical analyser and electrons possessing a much wider range of energies are simultaneously focused on to different parts of the focal plane. Only a small fraction of these can enter a single slit and detector at any given instant, assuming that the resolution is to be maintained. This is clearly an inefficient process, and it is possible to detect a wider range of energies simultaneously and still maintain the resolution, thereby reducing the time taken to record a complete spectrum of energy, and increasing the signal to noise ratio. The multichannel detector can take a number of different forms. The earliest electron spectrometers incorporating multichannel detectors were equipped with a number of discrete electron multipliers (usually between 2 and 6, but as many as 100 have been used, for example as described by O. Nilsson, R. Jarding, and K. Siegbahn in the Proceedings of the International Conference on Electron Spectroscopy, Asilomar, U.S.A., Sept. 1971, edited by D. A. Shirley, at page 141). The physical size of conventional multipliers clearly limits the number of detectors which can be used. Alternatively, an array of electron multipliers, known as a channelplate, incorporating as many as $10^7$ individual electron multipliers, may be used in preference to conventional single multipliers. Typically, a channelplate multiplier consists of a bundle of channel type multiplier tubes drawn down to a very small diameter (10–50 μm), and when used as a multidetector in an electron spectrometer they are used as an electron image intensifying device placed in the focal plane of the spectrometer. However, it is usually necessary to employ two channelplates in series to obtain the gain which can be achieved with a conventional single electron multiplier. The electrons emerging from the channelplate can be detected in a number of ways, for example by allowing them to impinge on a phosphor screen so that an optical image is produced which can be scanned and recorded by a television camera and video recording system, or an array of photodiodes can be positioned behind the phosphor screen in place of the television camera. Alternatively, a charge coupled imaging device can be used to record the image. In this way, at least a significant portion of the spectrum can be recorded at substantially the same instant. Another approach is to employ a resistive strip placed behind the channelplate from which it is possible to determine the position of each electron striking the strip from the relative magnitudes of the signals received at each end. A method of using this form of detector for electron spectrometry was described by C. D. Moak, S. Datz, F. Garcia-Santebanez and T. A. Carlson in the Journal of Electron Spectroscopy and Related Phenomena, 1975, 6, p 151. A two dimensional version, described by N. Gurker, M. F. Ebel, and H. Ebel in Surface and Interface Analysis, 1983, 5, p 13, can also be employed, and can be used to produce two dimensional images of a sample surface which is emitting electrons of a particular range of energies. However, in most cases the object of using a multidetector in electron spectrometry is to improve the sensitivity and signal to noise ratio of the spectrometer.

At first sight it would appear that using a multichannel detector in place of a single channel detector would increase the signal to noise ratio of a spectrum by a factor equal to the square root of the number of channels in the multichannel detector, as suggested by B. Wannberg, G. Gelius and K. Siegbahn in J. Phys. (E), 1974, 7, p 149. In practice, however, a variety of factors combine together so that for a typical analyser operating at a low pass energy E (in order to obtain the highest possible resolution for a given slit width) it is not usually possible to achieve more than a factor of 5–10 improvement in sensitivity by using a channelplate detector. In a conventional single channel instrument of this type the exit slit width may be 10% of the gap between the hemispheres, which clearly limits the gain in sensitivity to be had by utilizing all of the focal plane simultaneously, and this can only be achieved if the exit fringe field correcting slit (Herzog slit) is enlarged beyond its optimum dimensions. This causes increased aberrations in the focussing of the spectrometer and reduces the resolution. Another problem is also encountered when a channel plate type of detector is used with a spectrometer operated in the constant retarding ratio (CRR) mode. As explained, it is better to retard the secondary electrons from the sample before they enter the spectrometer so that it can be operated at a lower pass energy and hence yield greater sensitivity for a particular resolution. In one mode of operation, the pass energy of the analyser is kept constant, and the spectrum is scanned by varying the extent of the retardation. It is often preferable, however, especially in Auger spectrometry, to retard all the electrons entering the spectrometer by a constant factor, and simultaneously to scan the pass energy of the spectrometer to record the spectrum. This is known as the constant retarding ratio (CRR) mode, and when a channelplate detector is used on a spectrometer operated in this way, it will be seen that the range of energy corresponding to a particular distance along the focal plane will no longer be constant, which generally complicates the processing of the data from the multidetector. Further, the use of a channelplate detector means that it is more difficult to test or adjust the spectrometer because there is no fixed exit slit on its central trajectory. Consequently, in most cases there is little to be gained by the use of a channelplate multiplier and its associated complicated detection system in comparison with a limited number of single channel electron multipliers disposed along the focal plane.

It is an object of the present invention to provide a multichannel detector system for a dispersive, e.g. hemispherical, charged particle analyzer which is capable of achieving a substantial increase in sensitivity when fitted in place of a single channel detector, and which utilizes much of the focal plane of the spectrometer without reducing the resolution of the spectrometer. It is another object to provide a method of correcting the fringing fields at the exit of a hemispherical charged particle analyser which allows effective use of the focal plane without a significant loss of resolution of the spectrometer. It is another object to provide a detector assembly for a charged particle spectrometer which, without substantial changes, can be used either as a conventional single channel detector or as a multichannel detector. It is another object to provide a charged particle spectrometer which has substantially greater sensitivity than a spectrometer with a single channel detector operated at the same resolution but which does not require the use of sophisticated digital electronic or computing techniques to extract a spectrum from the signal generated by the detector, even when the spectrometer is operated in the constant retarding ratio mode.

Thus according to one aspect of the invention there is provided a charged particle energy spectrometer comprising an electrostatic dispersive charged particle energy analyser having an exit focal plane and a dispersion axis lying in said focal plane and a multiple channel detector means comprising a plurality of charged particle detectors having their entrances disposed substantially in said exit focal plane and adjacent to one another along said dispersion axis, characterized in that there is disposed between the exit of said analyser and said exit focal plane a fringing field corrector plate having therein a plurality of apertures each substantially aligned with a different channel of said multiple channel detector means.

In a preferred embodiment of the invention, the spectrometer further comprises an exit slit carrier disposed between said plate and said detector means and comprising a plurality of exit slit arrays at least one of which contains a plurality of slits and which are indexable to align the slit (or each slit where there are more than one) within an array with a respective aperture in said plate and with the channel of said detector means with which said aperture is aligned.

The plurality of charged particle detectors in the spectrometer and detector means of the invention may be in the form of a plurality of single channel detectors or may comprise one or more detectors capable of position sensitive detection in one or two dimensions and disposed along the dispersion axis of the spectrometer and with their entrances substantially in the exit focal plane.

Preferably the apertures in the fringing field corrector plate are slit-like, and disposed with their longest axes substantially perpendicular to said dispersion axis, and one is preferably situated on the central trajectory of the spectrometer so that the detector means may be used as a single channel detector by utilizing only the detector or detectors situated to receive the charged particles passing through the central slit. Preferably the dimensions of each of the apertures should be equal to those of a conventional Herzog correction slit employed on a corresponding single detector spectrometer operating at the same resolution. Further, the fringing field corrector plate preferably has substantially the same thickness as, and is mounted in the same position as, a plate containing a single aperture optimized according to Herzog to correct the fringing fields of an otherwise identical single channel spectrometer, and is maintained at the potential of the central trajectory of the analyser. However, the possibility of mounting the plate elsewhere and applying to it other electrical potentials in such a way as to produce a substantially equivalent effect on the analyser fringing fields is not excluded. Such an arrangement may require the plate to be split into sections with different electrical potentials applied to each edge of each slit in order to obtain optimum correction. By the use of a fringing field correction plate which incorporates several slits it is possible to utilize a large proportion of the focal plane and still provide satisfactory fringing field correction at the exit face of the analyser sectors, because none of the slits need be wider than the one employed in a Herzog plate for use with a single detector spectrometer.

In one embodiment of the invention, the charged particle detectors are single channel electron multipliers, the entrances of which are aligned with corresponding apertures in the fringing field corrector plate. Preferably one of the apertures is aligned with the central trajectory of the analyser and the others are disposed either side of it. Typically, three multipliers are used, but more can be fitted if desired. A complete spectrum can then be recorded simultaneously by each detector as the spectrometer pass energy, or the entrance retarding lens, is scanned over the desired range of energies. The spectra produced by each detector are identical but they are displaced from each other by an amount corresponding to the distance between the detectors which are spaced along the energy dispersion axis of the analyser. In order to produce a single spectrum with enhanced signal-to-noise ratio, it is simply necessary to displace the spectra along the energy axis and add them, preferably using a computer based data acquisition system.

It is advantageous to provide an exit beam defining plate containing an exit slit in front of each multiplier, each slit being aligned with a corresponding aperture in the fringing field corrector plate. The exit beam defining plate should be situated in the exit focal plane of the analyser with the multiplier entrances immediately behind it. The dimensions of the slits in the exit beam defining plate should be substantially the same as those in the exit beam defining plate of a similar single channel spectrometer.

In an alternative embodiment, a single channelplate multiplier can be fitted with its entrance face in the focal plane of the analyser. Its secondary electron detection system is arranged to have a limited number of channels, each one corresponding to one of the single channel multipliers of the previous embodiment. Typically a small number of plate like anodes can be used. The advantage of the channelplate detector is that the detector channels can be disposed more closely together, but in general its dynamic intensity range is lower than that of a single channel multiplier. In another version, an exit beam defining plate containing several slits can be fitted in the focal plane, and the channelplate multiplier fitted behind it.

A particularly useful arrangement of detectors comprises two discrete electron multipliers with a channelplate multiplier fitted between them, aligned with the central trajectory of the analyser. A fringing field corrector plate according to invention and having three slits is fitted between the analyser exit and the focal plane. Typically a resistive strip type position sensitive detector is used to detect electrons emerging from the channelplate. This arrangement permits three complete spectra to be recorded simultaneously when the spectrometer is scanned, and also the imaging detection of part of the spectrum on the central detector, using it as a conventional imaging detector. Many of the disadvantages of conventional multi-channel imaging detection are avoided when only a limited portion of the spectrum is recorded, so that this embodiment combines the advantages of both multi-channel imaging to record in detail interesting parts of the spectrum, and the use of several single channel, high dynamic range multipliers to record the entire spectrum.

Viewed from another aspect, the invention consists of a detector assembly for a charged particle energy spectrometer, said assembly comprising a multiple channel detector means having a plurality of charged particle detectors disposed with their entrances adjacent to one another along an axis, a fringing field corrector plate spaced apart from said multiple channel detector means and having therein a plurality of apertures each aligned with a different channel of said multiple channel detector means, an exit slit carrier disposed between said multiple channel detector means and said plate and comprising a plurality of exit slit arrays at least one of which contains a plurality of slits and which are indexable to align the or each exit slit within an array with a respective aperture in said plate and with the channel of said multiple channel detector means with which said aperture is aligned, and means for indexing said exit slit carrier.

Preferably each aperture in the fringing field corrector plate is slit-like and of is the same shape and size as the fringing field corrector slit that would be used to obtain optimum correction on a single channel spectrometer. Preferably also the fringing field corrector plate has substantially the same thickness as, and is mounted relative to the multiple channel detector means in the same position as, a plate containing a single aperture optimized according to Herzog to correct the fringing fields of an otherwise identical single channel spectrometer. The exit slit carrier in the detector assembly is provided with indexing means and conveniently is in the form of a rotatable plate with the slit arrays arranged about the circumference of a circle centred on the rotation axis.

It will be appreciated that although an electrostatic spectrometer of the type to which this invention applies can be used for analysis of any species of charged particle, i.e. ions or electrons, a very common use is for energy spectral analysis of secondary electrons emitted from a sample during bombardment with a variety of primary radiations, as previously explained. The spectrometer of the invention is thus particularly suitably an electron energy spectrometer and it preferably incorporates as an analyser a substantially hemispherical sector and as detectors either a number of individual electron multipliers and/or a channelplate type of electron multiplier, as previously explained.

A preferred embodiment of the invention will now be described in greater detail by way of example and with reference to the accompanying drawings, in which:

FIGS. 5 and 6 show sectional views of further embodiments of a hemispherical sector electron spectrometer according to the invention.

Figure 1:
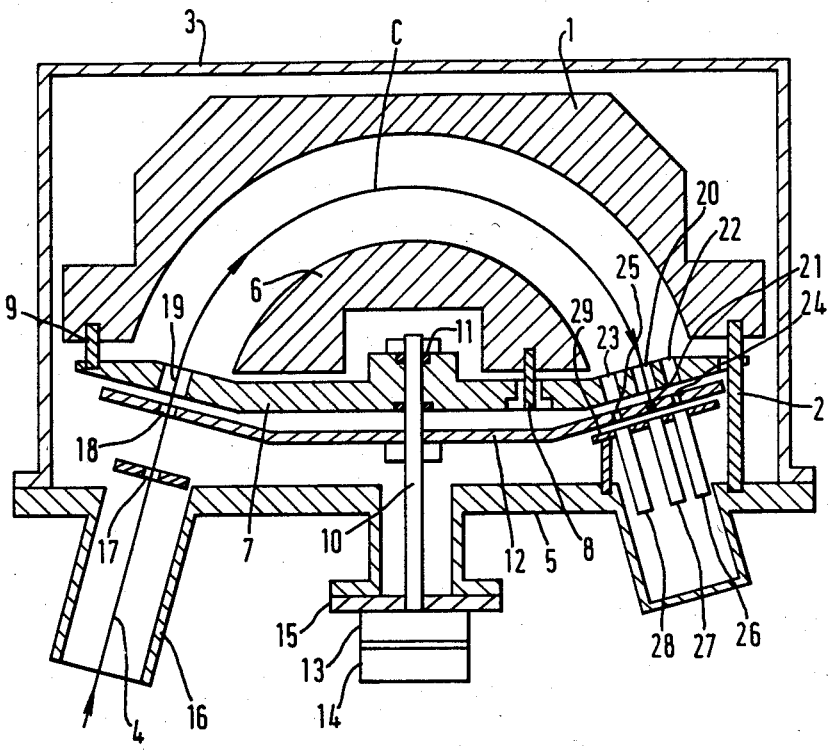
FIG. 1 shows a sectional view of a hemispherical sector electron spectrometer according to the invention.

Referring first to FIG. 1, the outer hemisphere 1 is supported from baseplate 5 by means of a number of electrically insulated supports 2. The inner hemisphere 6 is mounted on fringing field corrector plate 7 by means of insulated supports 8, and plate 7 is attached to outer hemisphere 1 by insulated supports 9. The entire analyser is housed in a vacuum tight enclosure 3 which is evacuated by a suitable high vacuum pump attached to a port (not shown) on base plate 5. Enclosure 3 is fabricated from mumetal in order to minimize the stray magnetic fields in the vicinity of the hemispheres. A shaft 10 is free to rotate in bearings 11 in plate 7, and carries the slit carrier plate 12. Shaft 10 passes through a rotary vacuum seal 13 mounted on flange 15 and can be rotated from outside the vacuum system by knob 14.

A beam 4 of electrons to be analysed enters the spectrometer along its central trajectory through port 16 and passes through a fixed slit 17, which may form part of an electrode structure used for focussing or retarding the electron beam, and the entrance slit 18 of the spectrometer which is formed in plate 12. Slits 17 and 18 are positioned to define the entrance acceptance angle of the spectrometer. It will be appreciated that the details of the arrangement of the input lens and slits will largely be determined by the application of the analyser. Any suitable arrangement can be employed, including the type which incorporate "virtual" slits, that is, where the beam width is determined by the focussing action of the lenses rather than by the passage of the beam through a real aperture.

The electron beam 4 then passes through a slit 19 in plate 7, which serves as the entrance fringing field corrector slit. The dimensions of this slit are preferably, but not essentially, determined according to Herzog. The beam then passes between the hemispheres, where its trajectory is determined by the energy of the electrons which constitute it. The hemispheres are maintained at different electrical potentials so that the potential along the central trajectory is equal to the potential of the plates 7 and 12, and the field between them is proportional to $1/r^2$, where r is the radial distance measured from the centre of the hemispheres. Electrons having energies very close to the pass energy of the analyser, which is determined by the actual values of the hemisphere potentials, will follow substantially the central trajectory C illustrated in FIG. 1, and pass through slits 20 and 21 in the fringing field corrector plate 7 and slit plate 12 respectively. Two further slits, 22 and 23 are made in the fringing field corrector plate 7, disposed either side of slit 20 along the dispersion axis of the spectrometer. Plate 7 is preferably positioned, and slits 20, 22 and 23 are preferably dimensioned, according to Herzog, but other arrangements are not excluded. Two further slits 24 and 25 are made in slit plate 12, corresponding to slits 22 and 23 in plate 7. Slits 21, 24 and 25 in slit plate 12 are situated in the exit focal plane of the spectrometer, as shown in FIG. 1. Electrons possessing a certain higher energy than those travelling along trajectory C are deflected to a lesser extent, and pass through slits 22 and 24. Those with a certain lower energy are deflected to a greater extent, and pass through slits 23 and 25. Three channel type electron multipliers, 26, 27 and 28, preferably enclosed in screened boxes, are attached to fixed support 29, and are positioned to receive the electrons passing through slits 24, 21 and 25 in plate 12. Alternatively, as shown in FIG. 5, two discreet electron multipliers 26 and 28 and a channelplate electron multiplier 59 may be provided. Conventional means 58 for determining the position of electrons leaving the channelplate, such as a charge coupled imaging device or a resistive strip detector, is also provided.

Figure 2:
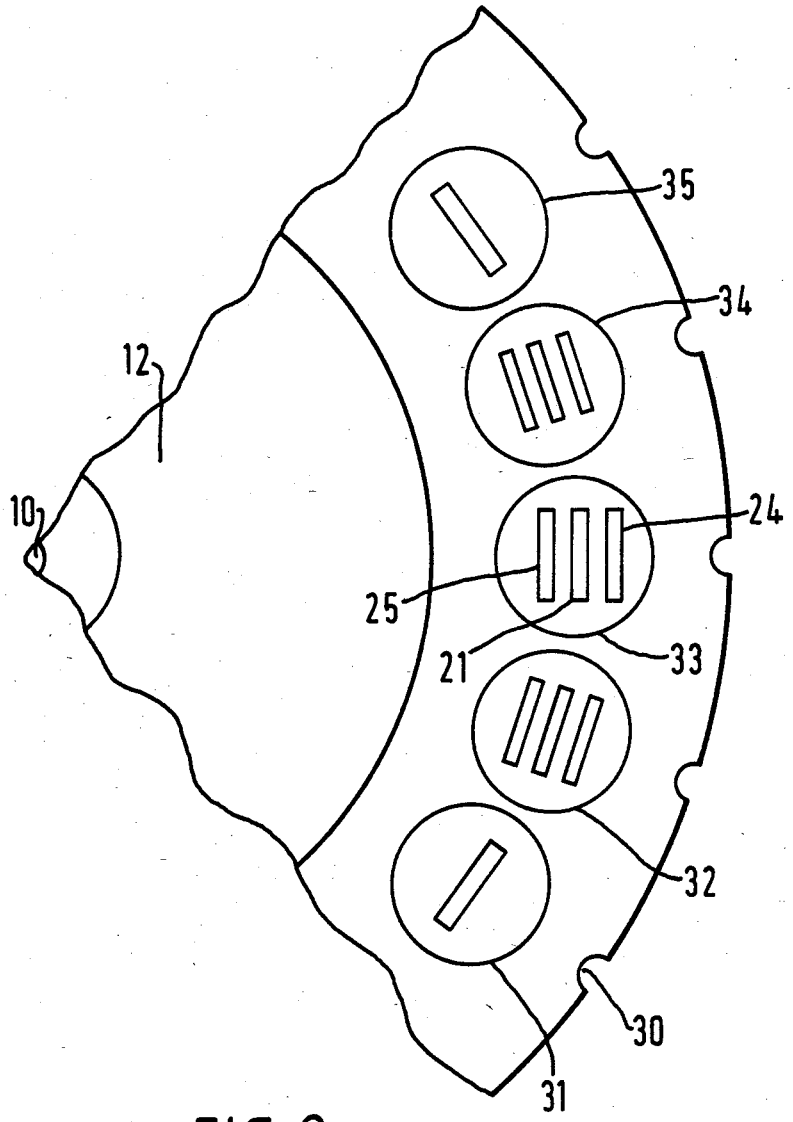
FIG. 2 shows an electron exit beam defining plate suitable for use with the spectrometer of FIG. 1.

Plate 12, part of which is illustrated in FIG. 2, can be rotated by means of knob 14 and shaft 10 to position different sets of entrance slits 18 and exit slits 21, 24 and 25 in the operating position of the spectrometer. In this way the resolution and transmission of the spectrometer can be selected. An indexing mechanism which consists of a spring loaded roller engaging in slots 30 cut in the circumference of plate 12, is provided to ensure that the sets of slits are properly positioned as plate 12 is rotated. Typically ten sets of entrance and exit slits are provided around plate 12. Each slit, or group of slits, is formed in a thin plate attached over a circular hole in plate 12, for example 31–35 in FIG. 2. It will be appreciated that these slits can be arranged in any convenient way, but by way of example, slit positions 32, 33 and 34 are shown each fitted with 3 identical slits according to one version of the invention, and positions 31 and 35 are shown with a single exit slit for conventional single detector operation. Plate 12 also carries a set of entrance slits situated diametically opposite to each of the exit slits. The entrance slits consist of of only a single slit, but both slits 17 and 18 (FIG. 1) may be mounted on plate 12 if desired. Different pairs of entrance and exit slits are brought into use simply by rotating plate 12, and slits of different width can be fitted so that the resolution and transmission characteristics of the analyser can easily be changed from outside the vacuum system. The fringing field corrector plate 7 contains three slits on the exit side to allow the use of three detectors. There is no necessity for this plate to rotate, because the size of the fringe field correction slits is not dependent on the size of the exit slits in plate 12. When it is required to operate the spectrometer as a conventional single detector instrument, it is only necesary to rotate plate 12 so that one of the single exit slits is positioned in the operating position. Only electrons passing through the central slit in the fringing field corrector plate will then pass through the selected exit slit and into multiplier 27. No electrons will be received in multipliers 26 and 28, nor will the resolution of the instrument be adversely affected by the presence of the additional slits 22 and 23 in plate 7, as previously explained. The invention therefore provides a very convenient way of changing from a single to a multiple detector system, which facilitates test and adjustment. It is also possible to utilize only the signal from the central detector 27, even when three exit slits are in the operating position, and obtain equivalent performance to a conventional single collector instrument, which is impossible with prior art multidetector spectrometers.

Although there is advantage in making the entrance and exit slits selectable, it will be seen that this is not an essential feature of the invention, and fixed slits can be used if desired. This still allows conventional single collector operation, as explained.

Figure 3:
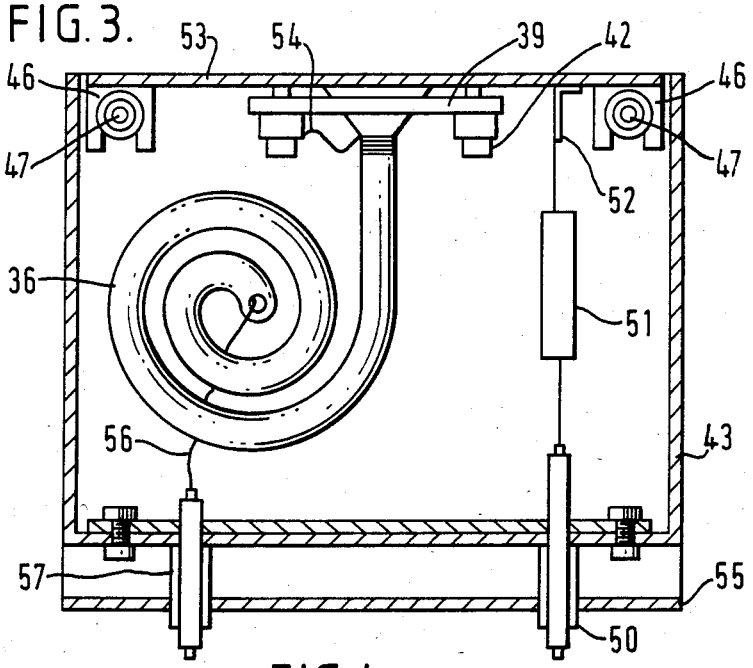
FIGS. 3 and 4 show two elevations of a detector suitable for use in the spectrometer of FIG. 1.
Figure 4:
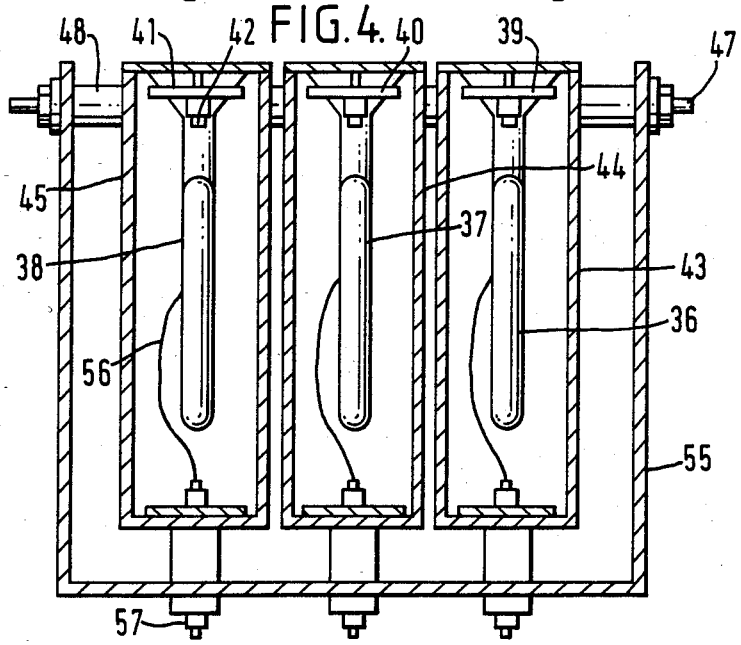

FIGS. 3 and 4 show two elevations of a triple detector suitable for use with the instrument described. Three channel type electron multipliers 36, 37 and 38 are attached by clamps 39, 40 and 41 to the top plates of the shielded boxes 43, 44 and 45 by means of screws and insulators 42. The top plates of boxes 43, 44 and 45 contain holes through which the electrons can pass into the entrances of the multipliers. The shielding boxes 43-45 are supported by brackets 46 which are mounted on, but electrically insulated from, rods 47, and spaced apart by insulators 48. The high tension supply for the multipliers is supplied through feedthroughs 50, resistors 51, brackets 52, top plates 53 and wire 54, and the signal output of each multiplier is connected through wires 56 and feedthroughs 57. The complete assembly of the three multipliers and their shielding boxes is enclosed in case 55 which in turn is attached to support plate 29 (FIG. 1). The centre line of each multiplier is of course arranged to correspond with the centres of the three exit slits in plate 12.

Several different methods of processing the signals from the electron multipliers can be employed. For example, the pulses produced by each multiplier in a given time can be counted, as is done in many conventional electron spectrometers, and the counts stored in the memory of a digital computer or multichannel analyser to which they relate, so that the complete spectrum is stored. The techniques required to process the multiplier signals from a multidetector spectrometer are well known in the art and need not be described further. However, it will be appreciated that the problem is greatly simplified by using only a small number of detector channels which have a fixed geometrical relationship with each other.

Although the use of a small number of individual multiplier detectors is the simplest way of realizing the invention, the use of an arrray of multipliers, such as a channelplate, does have some advantages. In this embodiment, shown in FIG. 6, the multipliers 26, 27 and 28 of FIG. 1 are omitted and a channelplate 60 is fitted in the plane of support plate 29. In this case the exit slits 21, 24 and 25 are retained, and the apparatus functions exactly as the discrete detector version. The use of a channelplate permits the slits to be closer together, therefore reducing the "dead space" between the channels, and in some cases it may be worthwhile to increase the number of channels, perhaps to 5. However, a better way of utilizing the channelplate is to mount it substantially in the exit focal plane of the spectrometer in place of the slits 21, 24 and 25 in plate 12. The function of these slits is to dissect the image into three separate channels, and this function can be effectively carried out on the channels to the different energy channels, without the need for the slits.

In general it is necessary to use two channelplate multipliers in series to achieve the same gain as a single channel multiplier, but this does not significantly modify the previous description. Any prior art detector means 61 (described above) can be employed with the channelplate, but it will be appreciated that resolution only in one dimension is required, and the resolution does not need to be very high because the number of detector channels is limited.

I claim:

1. A charged particle energy spectrometer comprising an electrostatic dispersive charged particle energy analyser having an exit focal plane and a dispersion axis lying in said focal plane and a multiple channel detector means comprising a plurality of charged particle detectors having their entrances disposed substantially in said focal plane and adjacent to one another along said dispersion axis, the improvement comprising disposed between the exit of said analyser and said exit focal plane a fringing field corrector plate having therein a plurality of apertures each substantially aligned with a different channel of said multiple channel detector means.

2. A spectrometer as claimed in claim 1 further comprising an exit slit carrier disposed between said plate and said detector means and comprising a plurality of exit slit arrays at least one of which contains a plurality of slits, said carrier being indexable to align each slit within an array with a respective aperture in said plate and with the channel of said detector means with which said aperture is aligned.

3. A spectrometer according to claim 1 in which said apertures are slit-like and disposed with their longest axes substantially perpendicular to said dispersion axis and in which said plurality of charged particle detectors comprises a plurality of single channel electron multipliers, the entrance of each said multiplier being substantially aligned with a different aperture in said plate.

4. A spectrometer according to claim 1 in which said apertures are slit-like and disposed with their longest axes substantially perpendicular to said dispersion axis and in which said plurality of charged particle detectors comprises at least one channelplate electron multiplier and means for detecting electrons emerging from said channelplate, said means for detecting being arranged to provide a plurality of detector channels each being substantially aligned with a different aperture in said plate.

5. A spectrometer according to claim 1 in which said plurality of charged particle detectors comprises at least one channelplate electron multiplier disposed to receive charged particles passing through one of said apertures in said plate, and at least one single-channel electron multiplier disposed adjacent to said channelplate and to receive charged particles passing through a further aperture in said plate, said channelplate being provided with position sensitive means for detecting the electrons leaving it.

6. A spectrometer according to claim 1 in which said plate disposed between said exit of said analyser and said exit focal plane has substantially the same thickness as, and is mounted in substantially the same position as the optimum fringing field corrector plate for a corresponding spectrometer which has in place of said multichannel detector means a signle channel detector means, and in which said plate has apertures of substantially the same size and shape as the single aperture of said optimum fringing field corrector plate.

7. A spectrometer according to claim 1 being an electron energy spectrometer in which said analyser is a substantially hemispherical sector analyser.

8. A spectrometer according to claim 2 being an electron energy spectrometer in which said analyser is a substantially hemispherical sector analyser.

9. A spectrometer according to claim 3 being an electron energy spectrometer in which said analyser is a substantially hemispherical sector analyser.

10. A spectrometer according to claim 4 being an electron energy spectrometer in which said analyser is a substantially hemispherical sector analyser.

11. A spectrometer according to claim 5 being an electron energy spectrometer in which said analyser is a substantially hemispherical sector analyser.

12. A spectrometer according to claim 6 being an electron energy spectrometer in which said analyser is a substantially hemispherical sector analyser.

13. A spectrometer according to claim 12 further comprising an exit slit carrier disposed between said plate and said detector means and comprising a plurality of exit slit arrays at least one of which contains a plurality of slits, said carrier being indexable to align each slit within an array with a respective aperture in said plate and with the channel of said detector means with which said aperture is aligned.

14. A spectrometer according to claim 12 in which said apertures are slit-like and disposed with their longest axes substantially perpendicular to said dispersion axis and in which said plurality of charged particle detectors comprises a plurality of single channel electron multipliers, the entrance of each said multiplier being substantially aligned with a different aperture in said plate.

15. A spectrometer according to claim 12 in which said apertures are slit-like and disposed with their longest axes substantially perpendicular to said dispersion axis and in which said plurality of charged particle detectors comprises at least one channelplate electron multiplier and means for detecting electrons emerging from said channelplate, said means for detecting being arranged to provide a plurality of detector channels each being substantially aligned with a different aperture in said plate.

16. A spectrometer according to claim 12 in which said plurality of charged particle detectors comprises at least one channelplate electron multiplier disposed to receive charged particles passing through one of said apertures in said plate, and at least one single-channel electron multiplier disposed adjacent to said channelplate and to receive charged particles passing through a further aperture in said plate, said channelplate being provided with position sensitive means for detecting the electrons leaving it.

17. A spectrometer according to claim 12 in which one of said apertures in said plate is substantially aligned with the central trajectory of said analyser.

18. A spectrometer according to claim 17 further provided with means for maintaining said plate at the potential of the central trajectory of said analyser.

19. A detector assembly for a charged particle energy spectrometer, said assembly comprising a multiple channel detector means having a plurality of charged particle detectors with their entrances adjacent to one another along an axis, a fringing field corrector plate spaced apart from said multiple channel detector means and having therein a plurality of apertures each aligned with a different channel of said multiple channel detector means, an exit slit carrier disposed between said multiple channel detector means and said plate and comprising a plurality of exit slit arrays at least one of which contains a plurality of slits, said carrier being indexable to align each exit slit within an array with a respective aperture in said plate and with the channel of said multiple channel detector means with which said aperture is aligned, and means for indexing said exit slit carrier.

* * * * *